US011124906B2

(12) United States Patent
Inoue et al.

(10) Patent No.: US 11,124,906 B2
(45) Date of Patent: Sep. 21, 2021

(54) METAL FIBER NONWOVEN FABRIC

(71) Applicant: Tomoegawa Co., Ltd., Tokyo (JP)

(72) Inventors: Tatsunari Inoue, Shizuoka (JP); Hideki Moriuchi, Shizuoka (JP); Taku Kurahara, Shizuoka (JP); Daisuke Muramatsu, Shizuoka (JP)

(73) Assignee: Tomoegawa Co., Ltd., Tokyo (JP)

( * ) Notice: Subject to any disclaimer, the term of this patent is extended or adjusted under 35 U.S.C. 154(b) by 0 days.

(21) Appl. No.: 16/330,893

(22) PCT Filed: Jan. 11, 2018

(86) PCT No.: PCT/JP2018/000506

§ 371 (c)(1),
(2) Date: Mar. 6, 2019

(87) PCT Pub. No.: WO2018/131658

PCT Pub. Date: Jul. 19, 2018

(65) Prior Publication Data

US 2019/0211485 A1 Jul. 11, 2019

(30) Foreign Application Priority Data

Jan. 16, 2017 (JP) ..... JP2017-004802

(51) Int. Cl.
*D04H 1/4234* (2012.01)
*D04H 1/732* (2012.01)
*D04H 1/54* (2012.01)

(52) U.S. Cl.
CPC ..... *D04H 1/4234* (2013.01); *D04H 1/54* (2013.01); *D04H 1/732* (2013.01); *Y10T 442/655* (2015.04)

(58) Field of Classification Search
CPC ..... D04H 1/4234; D04H 1/54; D04H 1/732
USPC ..... 428/546
See application file for complete search history.

(56) References Cited

U.S. PATENT DOCUMENTS

2007/0184741 A1* 8/2007 Groten ..... D04H 3/013 442/327

FOREIGN PATENT DOCUMENTS

| | | | |
|---|---|---|---|
| EP | 3517673 | A1 | 7/2019 |
| JP | 61225400 | A | 10/1986 |
| JP | S61223105 | A | 10/1986 |
| JP | S61225398 | A | 10/1986 |
| JP | 61289200 | A | 12/1986 |
| JP | 08232187 | A | 9/1996 |
| JP | H11131105 | A | 5/1999 |
| JP | 2000080591 | A | 3/2000 |

(Continued)

OTHER PUBLICATIONS

PCT Office, International Search Report issued in PCT/JP2018/000506 dated Feb. 27, 2018, 4 pages.

(Continued)

*Primary Examiner* — Humera N. Sheikh
*Assistant Examiner* — Katherine A Christy
(74) *Attorney, Agent, or Firm* — Wood Herron & Evans LLP

(57) ABSTRACT

One object of the present invention is to provide a metal fiber nonwoven fabric having high homogeneity, and the present invention provides a metal fiber nonwoven fabric in which metal fibers are bonded to each other having a coefficient of variation (CV value) of a basis weight in accordance with JIS Z 8101 (ISO 3534: 2006) per 1 $cm^2$ of 10% or less.

6 Claims, 4 Drawing Sheets

(56) References Cited

FOREIGN PATENT DOCUMENTS

| | | | | |
|---|---|---|---|---|
| JP | 2000216583 | A | 8/2000 | |
| JP | 2007533865 | A | 11/2007 | |
| TW | 201026386 | A | 7/2010 | |
| WO | 9843756 | A1 | 10/1998 | |
| WO | WO-2005099864 | A1 * | 10/2005 | ..... B01D 39/2048 |

OTHER PUBLICATIONS

European Patent Office, Search Report issued in EP 18739125.5 dated Mar. 16, 2020, 7 pages.
Taiwan Patent Office, Office Action issued in TW 107100788 dated Dec. 4, 2020.
Chinese Patent Office, Office Action issued in CN 201880004079.1 dated Jun. 10, 2021.

* cited by examiner

METAL FIBER NONWOVEN FABRIC

TECHNICAL FIELD

The present invention relates to a metal fiber nonwoven fabric in which metal fibers are bonded to each other.

BACKGROUND ART

Conventionally, as a sheet material which has fine pores and is made of 100% metal, many sheets, such as a woven wire net, a dry web, a wet web, a powdered sintered body, and a metal sheet which is obtained by plating a nonwoven fabric, and then the nonwoven fabric is degreased, have been used. In addition, in sheet materials made of metal fibers, metal powders and the like are generally sintered in a vacuum or in a non-oxidizing atmosphere to fix the overlapping portions of the metal fibers to form a sheet.

Among such sheet materials, a metal fiber nonwoven fabric which is obtained by paper-making a slurry containing metal fibers by a wet paper-making method has been known. From the characteristics of the manufacturing method referred to as the paper-making method, the metal fiber nonwoven fabric obtained by the wet paper-making method has metal fibers irregularly oriented, uniform in sheet texture, thin and dense. For this reason, the metal fiber nonwoven fabric obtained by the wet paper-making method can be used in many fields such as a filter material, a cushioning material, an electromagnetic wave-shielding material and the like.

As the paper-making method, for example, a method for manufacturing a metal fiber nonwoven fabric for electromagnetic wave shielding which is obtained by mixing metal fibers together with water-soluble polyvinyl alcohol, a water-insoluble thermoplastic resin, and an organic polymeric viscous agent, paper-making the mixture, and pressing it under heating at a temperature higher than the melting point of the water-insoluble thermoplastic resin has been proposed (for example, Patent Document 1).

In addition, attempts have also been made to obtain a metal fiber nonwoven fabric having gloss unique to metal by entangling the metal fibers with a high pressure jet water stream without using resin fibers or the like (see, for example, Patent Document 2).

PRIOR ART DOCUMENTS

Patent Literature

Patent Document 1 Japanese Unexamined Patent Application, First Publication No. S61-289200

Patent Document 2 Japanese Unexamined Patent Application, First Publication No. 2000-80591

SUMMARY OF INVENTION

Problem to be Solved by the Invention

As described above, the metal fiber nonwoven fabric can be used in many fields such as a filter material, a cushioning material, an electromagnetic wave-shielding material and the like. However, there are cases in which the weight dispersion and the like of one sheet of the metal fiber nonwoven fabric are relatively large. Accordingly, there are cases in which the usage applications are limited. For this reason, a metal fiber nonwoven fabric having higher homogeneity than a conventional metal fiber nonwoven fabric has been desired for various applications.

For example, when the metal fiber nonwoven fabric is used as a member for precision electronic parts, the metal fiber nonwoven fabric is used in a small area (piece). However, in the conventional metal fiber nonwoven fabric, it has been difficult to produce a small area metal fiber nonwoven fabric having high homogeneity with a high product yield. Conventional metal fiber nonwoven fabric as a member for precision electronic parts was not always sufficiently dense and did not have homogeneous characteristics.

In addition, even when the metal fiber nonwoven fabric has a relatively large area, there has been a demand for a metal fiber nonwoven fabric in which in-plane variation such as electrical characteristics, physical properties, air permeability, and the like is suppressed to a low level.

However, it has been extremely difficult to highly homogenize a metal fiber nonwoven fabric containing metal fibers having high true density and plastic deformation properties.

In addition, because of its flexibility, the metal fiber nonwoven fabric has excellent disposability in a narrow space, degree of freedom of shape and the like. From this aspect, there is a high demand for a metal fiber nonwoven fabric having higher homogeneity.

However, since the method for producing the metal fiber nonwoven fabric and the metal fiber nonwoven fabric disclosed in Patent Documents 1 and 2 is not conscious of obtaining a highly homogeneous metal fiber nonwoven fabric, it cannot always be said that the metal fiber nonwoven fabric has sufficient high homogeneity.

The present invention has been made in view of the above circumstances, and an object of the present invention is to provide a metal fiber nonwoven fabric having high homogeneity such that even when it is a piece having a small area, it has small variations in individual pieces, and therefore, even when it has a relatively large area, it has small in-plane variation.

Means for Solving the Problem

As a result of intensive studies, the present inventors have found that when a coefficient of variation (CV value) of a basis weight in accordance with JIS Z 8101 per 1 $cm^2$ is 10% or less in a metal fiber nonwoven fabric in which metal fibers are bonded each other, high homogeneity can be obtained, and the present invention has been completed.

Further, it was found that a metal fiber nonwoven fabric having higher homogeneity can be obtained by adjusting an average length, an average diameter, a space factor, and the like of the metal fibers.

In other words, the present invention provides the following metal fiber nonwoven fabrics.

(1) A metal fiber nonwoven fabric in which metal fibers are bonded to each other having a coefficient of variation (CV value) of a basis weight in accordance with JIS Z 8101 (ISO 3534: 2006) per 1 $cm^2$ of 10% or less.

(2) The metal fiber nonwoven fabric according to (1), wherein the metal fibers have an average length of 1 to 10 mm.

(3) The metal fiber nonwoven fabric according to (1) or (2), wherein an average of the space factors of the metal fibers is 5% to 50%.

(4) The metal fiber nonwoven fabric according to any one of (1) to (3), wherein the metal fibers are copper fibers.

(5) The metal fiber nonwoven fabric according to any one of (1) to (4), wherein the metal fiber nonwoven fabric is a member for an electronic part.

Effects of the Invention

Since the metal fiber nonwoven fabric according to the present invention has high denseness and is homogeneous, it is used for various applications including a member for an electronic part.

Furthermore, when the metal fibers have a specific average length, it is possible to obtain a metal fiber nonwoven fabric in which metal fibers are easily entangled with each other moderately and so-called lumps are hardly generated.

In other words, the metal fiber nonwoven fabric of the present invention can produce individual pieces with an extremely small difference in quality when processed into an extremely small area form after being produced in an industrially sufficient area, and reduce the in-plane variation when processed into a relatively large area after being produced in an industrially sufficient area.

DETAILED DESCRIPTION OF THE PREFERRED EMBODIMENTS

Hereinafter, the metal fiber nonwoven fabric of the present invention will be described in detail, but the embodiments of the metal fiber nonwoven fabric of the present invention are not limited thereto.

The metal fiber nonwoven fabric of the present invention may contain only metal fibers, or may contain metal fibers and other material.

"Fibers are bonded to each other" refers to a state in which the metal fibers are physically fixed. A portion where the metal fibers are physically fixed is called a binding portion. In the binding portion, the metal fibers may be directly fixed to each other, or a some of the metal fibers may be indirectly fixed via a component other than a metal component.

Figure 1:
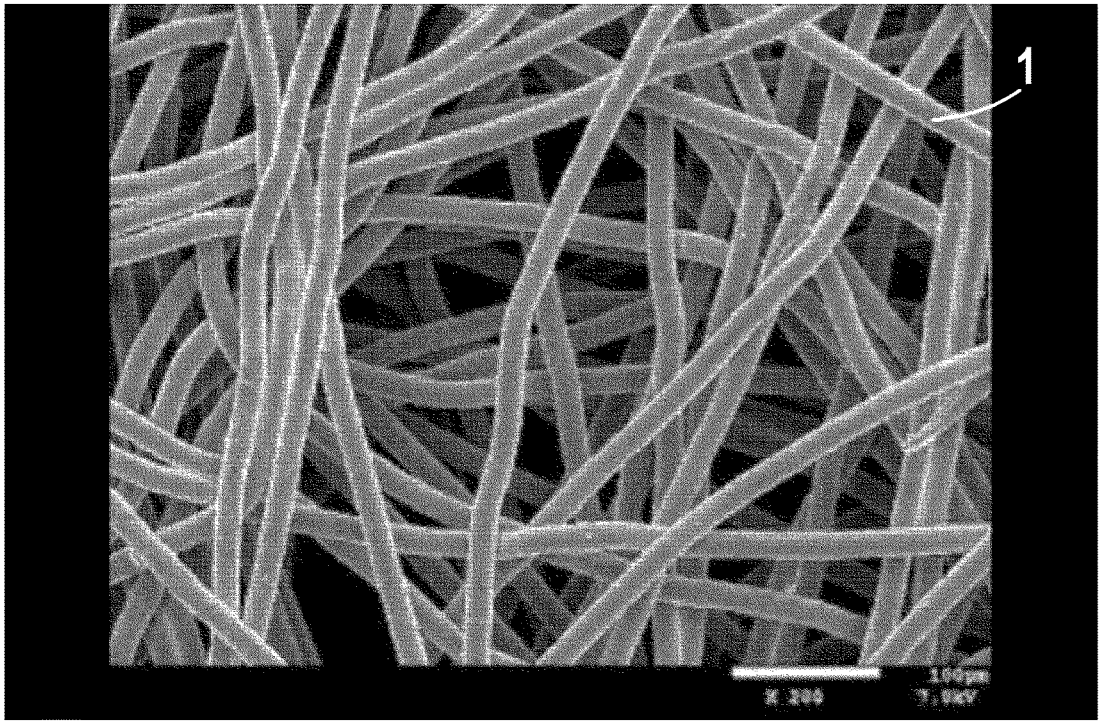
FIG. 1 is an SEM photograph showing a surface of a copper fiber nonwoven fabric.
Figure 2:
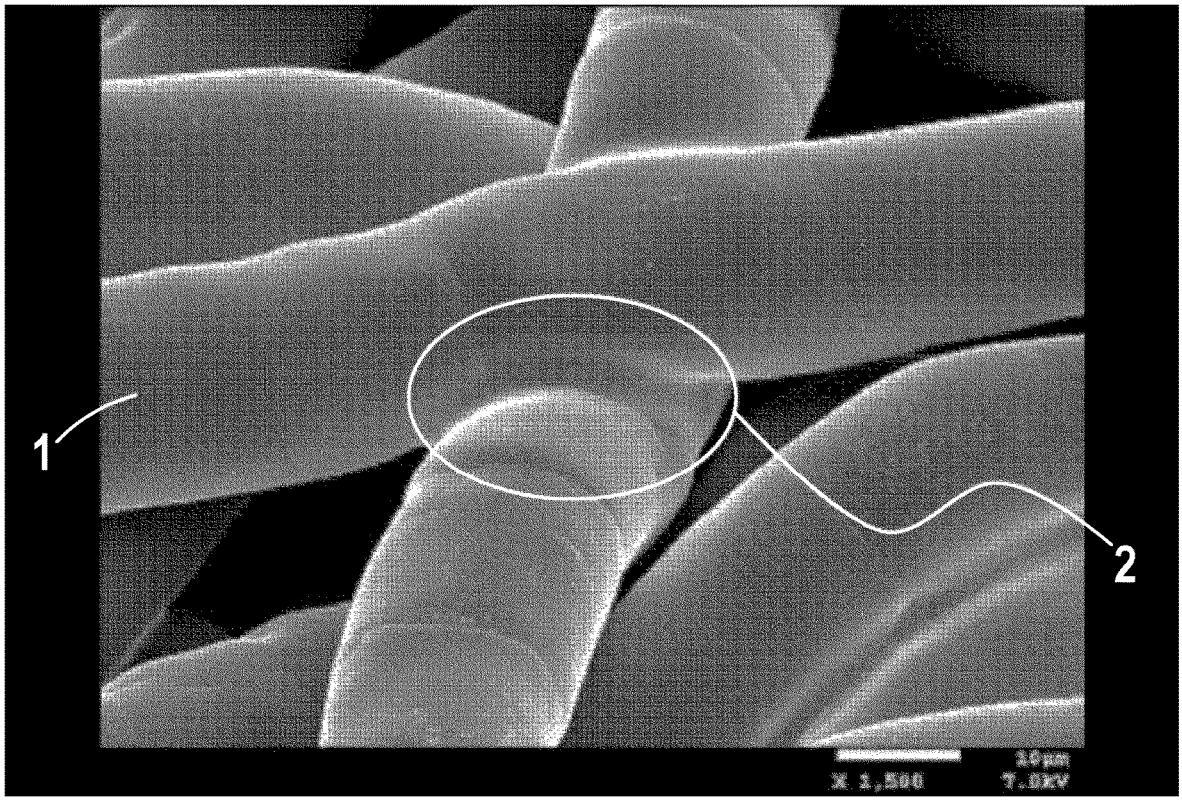
FIG. 2 is an enlarged SEM photograph of FIG. 1 showing a state in which copper fibers are bonded to each other.

FIG. 1 is an SEM photograph showing the metal fiber nonwoven fabric prepared using copper fibers, and a reference number 1 indicates a copper fiber. FI 2 is an enlarged SEM photograph of FIG. 1, and a reference numeral 2 denotes a binding portion of copper fibers.

Hereinafter, the metal fiber nonwoven fabric of the present invention will be described in more detail.

<1. Materials Constituting the Metal Fiber Nonwoven Fabric>

Specific examples of the metal fibers constituting the metal fiber nonwoven fabric include, but are not limited to, stainless steel, iron, copper, aluminum, bronze, brass, nickel, chromium, and noble metals such as gold, platinum, silver, palladium, rhodium, iridium, ruthenium, and osmium. Among them, copper fibers are preferable because the balance between rigidity and plastic deformability is moderate, and a metal fiber nonwoven fabric having sufficient homogeneity can be easily obtained.

As the component other than metal fibers, polyolefin resin such as polyethylene resin and polypropylene resin, polyethylene terephthalate (PET) resin, polyvinyl alcohol (PVA) resin, polyvinyl chloride resin, aramid resin, nylon, acrylic resins and the like, and fibrous materials made of these resins can be used.

Further, an organic substance or the like having a binding property and a carrying ability with respect to the metal fibers can also be used for the binding portion.

<2. Physical Properties of Metal Fibers and Metal Fiber Nonwoven Fabric>

The average diameter of the metal fibers used in the present invention can be arbitrarily set within the range not to impair the homogeneity of the nonwoven fabric. However, the average diameter of the metal fibers used in the present invention is preferably in a range of 1 μm to 30 μm, and more preferably in a range of 2 μm to 20 μm. When the average diameter of the metal fibers is 1 μm or more, moderate rigidity of the metal fibers can be obtained, so that there is a tendency that so-called lumps are less likely to occur when making the nonwoven, fabric. When the average diameter of the metal fibers is 30 μm or less, moderate flexibility of the metal fibers can be obtained, so that the fibers tend to be entangled moderately.

Since the uniformity of the metal fiber nonwoven fabric can be easily increased, the average diameter of the metal fibers is preferably as small as possible within a range that does not hinder the nonwoven fabric.

Further, "average diameter of metal fibers" in the present specification refers to an average diameter (for example, an average diameter of 20 fibers) which is obtained by calculating the cross-sectional area of the metal fiber (for example, using known software) in an arbitrary vertical cross section with respect to the longitudinal direction of the metal fiber nonwoven fabric imaged by the microscope, and calculating a diameter of a circle having the same area as the cross-sectional area of the metal fiber.

In addition, the cross-sectional shape perpendicular to the longitudinal direction of the metal fibers may be any shape such as a circle, an ellipse, a substantially quadrangle, an irregular shape, and the like, but is preferably a circle. Moreover, the circular cross section does not have to be a perfect circular cross section. The cross-sectional shape of the metal fiber may be any circular shape that is likely to cause a curved portion due to the stress applied when producing the metal fiber nonwoven fabric. Therefore, the cross-sectional shape of the metal fiber need not be a perfect circle.

Metal fibers having a circular cross section are easier to bend due to stress than metal fibers having a quadrilateral cross section. In addition, when metal fibers having a circular cross section receive stress, a difference in the degree of bending of the metal fibers easily occurs. Accordingly, the degree of bending tends to be homogenized.

For example, when a metal fiber nonwoven fabric is produced by a wet method described later, metal fibers having a circular cross section are likely to be bent due to contact with a slurry stirring blade or the like. When metal fibers having curved portions are entangled with each other appropriately, homogeneity of the metal fiber nonwoven fabric tends to be easily enhanced.

An average length of the metal fibers used in the present invention is preferably in a range of 1 mm to 10 mm, and more preferably in a range of 3 mm to 5 mm. It is preferable that the length of the metal fibers be as short as possible in the range that does not prevent the nonwoven fabric being made, since the homogeneity of the metal fiber nonwoven fabric can be easily increased.

When the average length is in the range of 1 mm to 10 mm, for example, when producing the metal fiber nonwoven fabric of the present invention by paper-making, so-called metal fiber lumps are hardly caused, and the degree of dispersion of the metal fibers can be easily controlled. In addition, since the metal fibers are entangled with each other appropriately, the effect of improving the handling strength of the metal fiber nonwoven fabric can be easily obtained.

The "average length" in the present specification is an average value of 20 pieces measured by a microscope.

In the case of cutting long metal fibers produced by a melt spinning method, a drawing method or the like to a desired length in order to adjust the length, it is not realistic to cut each metal fiber from the viewpoint of the fineness of the metal fibers. Therefore, a method of bundling and cutting the long metal fibers is used. However, in this case, it is preferable to cut the bundle of long metal fibers after sufficiently loosening them in advance. By sufficiently loosening the fibers, it is easy to suppress a phenomenon (for example, a pine needle phenomena) in which the cut surfaces between the metal fibers are fixed to each other during cutting. As a result, when forming a metal fiber nonwoven fabric, each metal fiber adopts an independent behavior, making it easier to obtain a metal fiber nonwoven fabric with higher homogeneity. In particular, it is effective to use this method for copper fibers with low hardness.

Further, the aspect ratio of the metal fibers used in the present invention is preferably in a range of 33 to 10,000, and more preferably in a range of 150 to 1,500. When the aspect ratio is 33 or more, so-called lumps are not easily caused and moderate entanglement of metal fibers tends to occur, so that appropriate handling strength of the metal fiber nonwoven fabric tends to be maintained. When the aspect ratio is 10,000 or less, handling strength can be sufficiently maintained and lumps are hardly caused, so excellent homogeneity of the metal fiber nonwoven fabric tends to be obtained.

The thickness of the metal fiber nonwoven fabric can be arbitrarily adjusted, but it is preferably in a range of 20 μm to 5 mm, for example.

Moreover, the "thickness of the metal fiber nonwoven fabric" in the present specification refers to an average thickness at any number of points in the metal fiber nonwoven fabric measured by using a terminal drop type film thickness meter (for example, Digimatic Indicator ID-C 112X made by Mitutoyo Corporation).

The space factor of the fibers in the metal fiber nonwoven fabric of the present invention is preferably in a range of 5 to 50%, and more preferably in a range of 15 to 40%. When the space factor of the fibers is 5% or more, an adequate homogeneity can be obtained since the fiber amount is sufficient. When the space factor of the fibers is 50% or less, not only moderate homogeneity but also desired flexibility of the metal fiber nonwoven fabric can be obtained.

The "space factor of the fibers in the metal fiber nonwoven fabric" in the present specification is a ratio of the portion where the fibers are present with respect to the volume of the metal fiber nonwoven fabric.

When the metal fiber nonwoven fabric is made of one kind of metal fiber, it is calculated from the basis weight and thickness of the metal fiber nonwoven fabric and the true density of the metal fibers by the following formula.

Space factor (%)=basis weight of metal fiber nonwoven fabric/(thickness of metal fiber nonwoven fabric×true density of metal fibers)×100

When the metal fiber nonwoven fabric contains a plurality of kinds of metal fibers, or fibers in addition to the metal fibers, the space factor can be calculated by adopting the true density value reflecting the composition ratio.

<3. Homogeneity of Metal Fiber Nonwoven Fabric>

In the metal fiber nonwoven fabric of the present invention, the coefficient of variation (CV value) of the basis weight in accordance with JIS Z 8101 (ISO 3534) per 1 $cm^2$ is 10% or less. The coefficient of variation of the basis weight is obtained by the following processes, for example.

1. A metal fiber nonwoven fabric to be measured is cut into 1 cm×1 cm square to obtain metal fiber nonwoven fabric pieces.

2. The individual pieces are weighed with a high-precision analytical balance (for example, manufactured by A & I Co., Ltd., trade name: BM-252) to obtain the mass.

3. Considering the possibility that the piece is not an exact square, a distance in the vicinity of the center of two parallel sides is measured and the measured values are taken as the vertical length and the horizontal length.

4. The area of each piece is calculated from the vertical length and the horizontal length.

5. The basis weight of each piece is calculated by dividing the mass by the area.

6. The coefficient of variation (CV value) of the basis weight of the piece of the metal fiber nonwoven fabric is calculated by dividing the standard deviation of the basis weight of all pieces by the average value and multiplying by 100.

Moreover, the variation coefficient can be stabilized by measuring, for example, 100 or more pieces. Further, when the area of the metal fiber nonwoven fabric as a measurement target is less than 1 $cm^2$, the value converted into 1 $cm^2$ may be used as the variation coefficient (CV value).

The basis weight is an index representing the weight per unit area. Therefore, when the coefficient of variation of the basis weight is equal to or less than a certain value, it can be said that the space factor, sheet resistance and the like of each piece are stable values. That is, when the coefficient of variation of the basis weight is 10% or less, it can be said that the metal fiber nonwoven fabric does not have large lumps and voids, and is sufficiently homogeneous; that is, the space factor of the fiber, sheet resistance, and the like are uniform through the entirety.

By appropriately adjusting the above various parameters, the coefficient of variation (CV value) of the basis weight in accordance with JIS Z 8101 (ISO 3534) per 1 $cm^2$ can be reduced to 10% or less. In particular, adjustment of the average length and the average diameter of the metal fibers is important.

Specifically, in the case in which the metal fiber nonwoven fabric is made of only one kind of metal fiber, it is preferable to use a metal fiber having an average length of preferably 1 mm to 10 mm, and more preferably 3 mm to 5 mm, and an average diameter of preferably 1 μm to 30 μm, and more preferably 2 pun to 20 μm.

<4. Fabrication of Metal Fiber Nonwoven Fabric>

As a method of obtaining the metal fiber nonwoven fabric of the present invention, it is possible to use a dry method in which the metal fibers or a web mainly made of metal fibers is compression molded, or a wet paper-making method using metal fibers or a raw material mainly containing metal fibers.

<4.1 Dry Method>

In the case of obtaining the metal fiber nonwoven fabric of the present invention by a dry method, metal fibers or a web mainly containing metal fibers which are produced by a card method, an air-laid method or the like are compression-molded. At this time, a binder may be impregnated between the fibers in order to bind the fibers together.

Examples of such a binder include, but are not limited to, organic binders such as acrylic adhesives, epoxy adhesives, and urethane adhesives, and inorganic binders such as colloidal silica, water glass, and sodium silicate.

Instead of impregnating the binder, a heat adhesive resin may be previously coated on the surface of the fiber, and metal fibers or an aggregate mainly made of metal fibers may be laminated and then pressurized and heat-compressed.

<4.2 Wet Paper-Making Method>

Further, the metal fiber nonwoven fabric of the present invention can also be produced by a wet paper-making method in which metal fibers or the like are dispersed in water and then the dispersion is subjected to paper-making.

Such a production method of a metal fiber nonwoven fabric includes a slurry preparing step of preparing a paper-making slurry by dispersing a fibrous material such as metal fibers in water, a paper-making step of producing a wet sheet from the paper-making slurry, a dehydration step of dehydrating the wet sheet, a drying step of drying the sheet after dehydration to obtain a dried sheet, and a binding step of binding metal fibers or the like constituting the dried sheet.

Moreover, a pressing step of pressing the sheet material between the dehydration step and the drying step, between the drying step and the binding step, and after the binding step may be carried out.

Each step will be described below.

(Slurry Preparing Step)

For example, a slurry of metal fibers or a slurry containing metal fibers and fibrous materials other than metal fibers is prepared using a stirring mixer, and a filler, a dispersant, a thickener, a defoaming agent, a paper-strengthening agent, a sizing agent, a coagulant, a coloring agent, a fixing agent and the like are appropriately added.

Examples of the fibrous materials other than the metal fibers include polyolefin resins such as polyethylene resin and polypropylene resin, polyethylene terephthalate (PET) resin, polyvinyl alcohol (PVA) resin, polyvinyl chloride resin, aramid resin, nylon, and acrylic resin.

The fibrous materials made of the resin can also be added to the slurry since they exhibit a binding property by heat melting.

However, in the case in which the binding portion is produced between metal fibers by sintering, it is preferable that there be no organic fibers or the like between the metal fibers because the binding portion can be reliably and easily produced.

In the case of paper-making the metal fibers without the presence of organic fibers or the like as described above, agglomerates such as so-called lumps are easily caused due to a difference in true density between water and the metal fibers and an excessive entanglement of the metal fibers. For this reason, it is preferable to appropriately use a thickener or the like.

Further, the metal fibers having a high true density in the slurry in the stirring mixer tend to easily settle on the bottom of the mixer. Therefore, it is preferable to use a slurry excluding the vicinity of the bottom surface where the metal fiber ratio is relatively stable, as a slurry for paper-making.

In particular, the coefficient of variation (CV value) of the basis weight in accordance with JIS Z 8101 (ISO 3534) per 1 $cm^2$ can be kept low by sufficiently dispersing the fibers in the paper-making slurry. In order to sufficiently disperse the fibers, adjustment of the average length and average diameter of the fibers is important.

(Paper-Making Step)

Next, the slurry is subjected to a wet paper-making in a paper-making machine. As the paper-making machine, it is possible to use a cylinder paper-making machine, a Fourdrinier paper-making machine, a sharp net paper-making machine, an inclined paper-making machine, a combination paper-making machine combining the same or different paper-making machines among them.

(Dehydration Step)

Next, the wet paper after paper-making is dehydrated.

At the time of dehydration, it is preferable to equalize the water flow rate (dehydration amount) of dehydration in the plane of the paper-making machine, width direction, and the like. By making the water flow rate constant, the turbulence and the like at the time of dehydration are suppressed and the rate at which the metal fibers settle down to the paper-making net is made uniform, so that it is easy to obtain a metal fiber nonwoven fabric with high homogeneity. In order to make the water flow rate at dehydration constant, it is sufficient to exclude a structure that may be an obstacle to the water flow under the paper-making net.

(Drying Step)

After dehydration, the wet paper after the hydration step is dried using an air dryer, a cylinder dryer, a suction drum dryer, an infrared type dryer or the like.

Through such steps, a sheet containing the metal fibers can be obtained.

(Bonding Step)

Next, the metal fibers in the sheet are bound together. As a bonding method, a method of sintering a metal fiber nonwoven fabric, a method of binding by chemical etching, a method of laser welding, a method of binding by using 1H heating, a chemical bonding method, a thermal bonding method, or the like can be used. Among these methods, since the bonding between the metal fibers is securely performed, the metal fibers are fixed, and the coefficient of variation (CV value) of the basis weight can be easily stabilized, for example. The method of sintering the metal fiber nonwoven fabric is preferably used.

The method for sintering the metal fiber nonwoven fabric preferably includes a sintering step in which the metal fiber nonwoven fabric is sintered at a temperature equal to or lower than the melting point of the metal fibers in a vacuum or non-oxidizing atmosphere. In the metal fiber nonwoven fabric that has undergone the sintering step, organic matter is burned off. Even when the metal fiber nonwoven fabric consists solely of metal fibers, the contact points between the metal fibers are bonded to each other. Accordingly, it is easy to obtain a metal fiber nonwoven fabric with stable homogeneity.

Through the above steps, a metal fiber nonwoven fabric can be produced. In addition to the above steps, the following steps can be adopted.

(Fiber Entangling Treatment Step)

A fiber entangling treatment step, in which metal fibers or fibers mainly containing the metal fibers which forms a moisture-containing wet sheet on the paper-making net after the paper-making step are entangled with each other, may be carried out.

As the fiber entangling treatment step, a fiber entangling treatment step of jetting a high-pressure jet water stream to the wet sheet surface is preferable. Specifically, it is possible to entangle the metal fibers or the fibers made mainly of the metal fibers over the entire sheet by arranging a plurality of nozzles in a direction orthogonal to the flowing direction of the sheet, and simultaneously jetting a high-pressure jet water stream from the plurality of nozzles. After the step, the wet sheet is rolled up after the drying step.

(Pressing Step)

As mentioned above, the pressing step can be carried out between the dehydration step and the drying step, between the drying step and the binding step, and/or after the binding step. In particular, it is easy to form the binding portions between the metal fibers in the subsequent fiber entangling treatment step by carrying out the pressing step after the binding step. This is preferable because homogeneity of the metal fiber nonwoven fabric can be further improved.

Further, the pressing step may be carried out under heating or non-heating. However, when the metal fiber nonwoven fabric contains the organic fibers or the like which are melted by heating, it is effective to heat at a temperature equal to or more than the melting starting temperature.

When the metal fiber nonwoven fabric is made of only the metal fibers, it may be pressurized only. The pressure may be appropriately set in consideration of the thickness of the metal fiber nonwoven fabric. In the case of the metal fiber nonwoven fabric having a thickness of about 170 μm, for example, the pressing step is carried out at a linear pressure of less than 300 kg/cm$^2$, preferably less than 250 kg/cm$^2$, since it is easy to impart homogeneity to the fiber nonwoven fabric. In addition, it is also possible to adjust the space factor of the metal fibers in the metal fiber nonwoven fabric by the pressing step.

In addition, the pressing (pressurizing) step can also be carried out on the metal fiber nonwoven fabric sintered through a binding step. Homogeneity can be further improved by subjecting the metal fiber nonwoven fabric after the sintering step to the pressing step.

When the metal fiber nonwoven fabric in which fibers are randomly entangled is compressed in the thickness direction, fiber shift occurs not only in the thickness direction but also in the surface direction. As a result, it is expected that the metal fibers can be easily arranged also in a void space at the time of sintering, and this state is maintained by the plastic deformation characteristic of the metal fiber.

The pressure at the time of press (pressurization) may be appropriately set in consideration of the thickness of the metal fiber nonwoven fabric. The resistance value of the metal fiber sintered nonwoven fabric produced in this manner can be arbitrarily adjusted depending on the kind, thickness, density, and the like of the metal fibers. However, the resistance value of the sheet-like metal fiber nonwoven fabric obtained by sintering copper fibers is, for example, about 1.3 mΩ/□.

(Application of Metal Fiber Nonwoven Fabric)

Next, the applications of the metal fiber nonwoven fabric according to the present invention will be described.

The metal fiber nonwoven fabric of the present invention can be used for a wide variety of applications depending on the type and the like of metal used. For example, when the metal fiber nonwoven fabric of the present invention uses stainless steel fibers, the metal fiber nonwoven fabric can be used as a windshield of a microphone as a whole sound transmission material. The metal fiber nonwoven fabric of the present invention can also be used as an electromagnetic wave noise countermeasure member for use in an electronic circuit board for the purpose of suppressing electromagnetic waves. When the metal fiber nonwoven fabric of the present invention uses copper fibers, the metal fiber nonwoven fabric can be used as a heat-transfer material for use in solders for bonding a semiconductor chip as a measure against heat generation in a semiconductor. However, the metal fiber nonwoven fabric of the present invention can be widely used for heat radiation, heating, electromagnetic wave countermeasures and the like of building materials, vehicles, aircrafts, ships and the like in addition to these application.

Hereinafter, the metal fiber nonwoven fabric of the present invention will be described in more detail using Examples and Comparative Examples.

Example 1

Copper fibers having a diameter of 18.5 μm, an average length of 10 mm, and a cross-sectional shape having a substantially circular ring shape were dispersed in water, and a thickener was appropriately added to prepare a paper-making slurry. Next, a portion of the paper-making slurry at the bottom of the mixer where the copper fiber concentration was high was removed to obtain a paper-making slurry. The obtained paper-making slurry, basis weight of 300 g/m$^2$, was put on a paper-making net, and after dehydration and drying, a copper fiber nonwoven fabric was obtained.

Thereafter, the obtained copper fiber nonwoven fabric was pressed at a linear pressure of 80 kg/cm at a normal temperature and then heated in an atmosphere of 75% hydrogen gas and 25% nitrogen gas at 1,020° C. for 40 minutes to partially sinter between the copper fibers, and a copper fiber nonwoven fabric of Example 1 was produced. The thickness of the obtained copper fiber nonwoven fabric was 310 μm.

Figure 3:
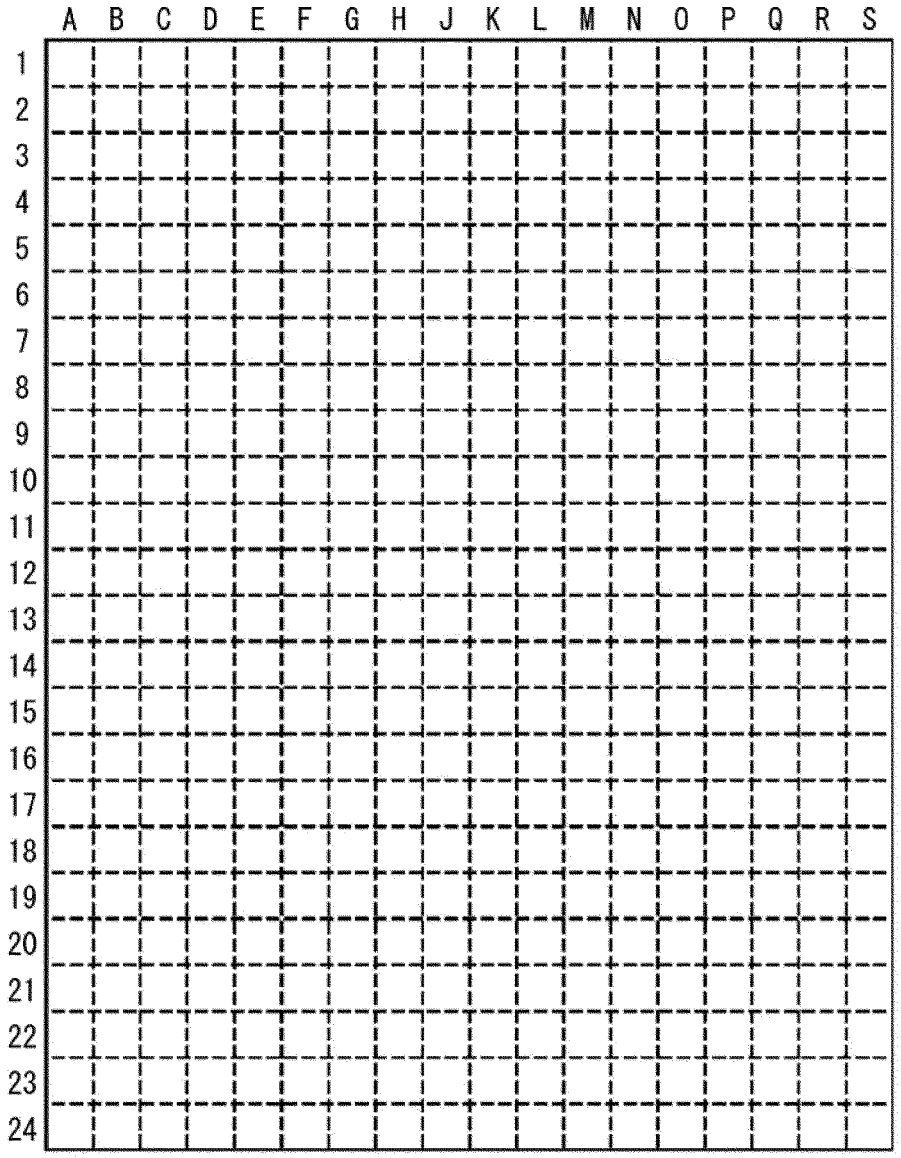
FIG. 3 is a mapping diagram of cut pieces of a metal fiber nonwoven fabric for measuring a coefficient of variation of a basis weight.

Next, the obtained copper fiber nonwoven fabric was cut into 24 cm×18 cm rectangles, then cut into 1 cm$^2$ pieces at dotted line portions in the mapping diagram of FIG. 3, and 432 pieces 4 were obtained by partitioning 1 to 24, and A to S (excluding 1). From the mass of the pieces 4 and the measured value of the area, the basis weight and the like of each piece 4 were calculated. The variation coefficient of the basis weight calculated from the standard deviation and the average value of all the pieces 4 was 9.1 and the average space factor of the copper fibers was 11.0%.

Example 2

Copper fiber nonwoven fabric pieces of Example 2 having a thickness of 303 μm and an average space factor of 12.7% were obtained in the same manner as in Example 1 except that the average length of the copper fibers was 5 mm. The coefficient of variation of the basis weight calculated by the same method as in Example 1 was 8.8.

Example 3

Copper fiber nonwoven fabric pieces of Example 3 having a thickness of 229 μm and an average space factor of 10.3% were obtained in the same manner us in Example 1 except that the average length of the copper fibers was 3 mm. The coefficient of variation of the basis weight calculated by the same method as in Example 1 was 5.2.

Example 4

Copper fiber nonwoven fabric pieces of Example 4 having a thickness of 102 μm and an average space factor of 34.5% were obtained in the same manner as in Example 2 except that the portion of the paper-making slurry having a high copper fiber concentration at the bottom of the mixer was not removed and pressed at a load of 240 kg/cm in the thickness direction after sintering. The variation coefficient of the basis weight calculated by the same method as in Example 1 was 5.8.

Example 5

Copper fiber nonwoven fabric pieces of Example 5 having a thickness of 101 μm and an average space factor of 33.5% were obtained in the same manner as in Example 4 except that before cutting the long copper fibers bundle, each fiber was sufficiently loosened, a structure which may be a hindrance to water flow under the paper-making net at the time of dehydration was removed, and paper-making was carried out in a state in which a turbulent flow at the time of dehydration was suppressed. The coefficient of variation of the basis weight calculated by the same method as in Example 1 was 3.9.

Comparative Example 1

Copper fibers without loosening the long fibers were cut to produce copper fibers having a diameter of 18.5 μm, an average length of 10 mm, and a substantially ring-shape in cross section. The obtained copper fibers were dispersed in water, and a thickener was appropriately added to make a paper-making slurry. The paper-making slurry obtained was poured onto a paper-making net with a basis weight of 300 g/m$^2$ as a target, and dehydrated and dried to obtain a copper fiber nonwoven fabric of Comparative Example 1. Thereafter, the nonwoven fabric was pressed at a linear pressure of 80 kg/cm at a normal temperature and then heated in an atmosphere of 75% hydrogen gas and 25% nitrogen gas at 1020° C. for 40 minutes to sinter the metal fibers, and thereby a copper fiber nonwoven fabric in Comparative Example 1 was obtained. The thickness of the obtained copper fiber nonwoven fabric was 284 Nm. The variation coefficient of the basis weight and the average space factor calculated by the same method as in Example 1 were 17.2 and 11.9% respectively.

Example 6

Stainless steel fibers having a diameter of 2 μm, an average length of 3 mm, and an irregular cross-sectional shape and PVA fibers (trade name: Fibribond VPB 105, manufactured by Kuraray Co., Ltd.) were dispersed in water at a weight ratio of 98:2, and a thickener was appropriately added to prepare a paper-making slurry. A stainless fiber nonwoven fabric was obtained by removing a paper-making slurry having a high concentration of stainless steel fibers at the bottom of the mixer from the paper-making slurry, and charging the residual paper-making slurry onto a paper-making net with a basis weight of 50 g/m$^2$ as a target, followed by dehydrating and drying to obtain a stainless steel fiber nonwoven fabric. Thereafter, the nonwoven fabric was pressed at a linear pressure of 80 kg/cm at a normal temperature and then heated at 1,120° C. for 60 minutes in an atmosphere of 75% hydrogen gas and 25% nitrogen gas to partially sinter the stainless steel fibers. Thus, a stainless steel nonwoven fabric of Example 6 was obtained. The thickness of the obtained stainless steel fiber nonwoven fabric was 152 μm.

Next, the obtained stainless steel fiber nonwoven fabric was cut into 24 cm×18 cm, and then cut into 1 cm$^2$ at dotted line portions of the mapping diagram of FIG. 3, and 432 pieces 4 were obtained by partitioning 1 to 24, and A to S (excluding 1). From the mass of the pieces 4 and the measured value of the area, the basis weight and the like of each piece 4 were calculated. The variation coefficient of the basis weight calculated from the standard deviation and the average value of all the pieces 4 was 2.3, and the average space factor of the stainless fibers was 4.0%.

Example 7

Stainless steel nonwoven fabric pieces of Example 7 having a thickness of 85 μm and an average space factor of 7.8% were obtained in the same manner as in Example 6 except that the average diameter of the stainless steel fibers was 8 μm. The coefficient of variation of the basis weight calculated by the same method as in Example 6 was 3.7.

Example 8

Stainless steel nonwoven fabric pieces of Example 8 having a thickness of 111 μm and an average space factor of 33.7% were obtained in the same manner as in Example 7 except that the pressing was carried out in the thickness direction with a load of 240 kg/cm$^2$ after sintering and the basis weight as a target was 300 g/cm$^2$. The variation coefficient of the basis weight calculated by the same method as in Example 6 was 7.1.

(Measurement of Sheet Thickness)

The thickness of the samples obtained by cutting the copper fiber nonwoven fabric obtained in Examples and Comparative Examples into 24 cm×18 cm was measured with a measuring terminal having a diameter of 15 mm using a Digimatic Indicator ID-C 112× made by Mitutoyo Corporation. The thickness of the obtained nonwoven fabric was measured at 9 places, and the average value was used as the thickness.

(Measurement of Dimension of Individual Pieces)

The dimensions of 432 copper fiber nonwoven fabric pieces obtained in the Examples and Comparative Examples were measured using a caliper having a minimum reading value of 0.05 mm in the following manner. Considering the possibility that the piece is not an exact square, the distance in the vicinity of the center of the two parallel sides was measured with the caliper, the measured values were set as the vertical length and the horizontal length, and the area of each piece 4 was calculated using the vertical length and the horizontal length.

(Measurement of Mass of Individual Piece)

The mass of a total of 432 copper fiber nonwoven fabric pieces obtained in the Examples and Comparative Examples was weighed with a high-precision analytical balance (trade name: BM-252, manufactured by A & I Co., Ltd.).

(Coefficient of Variation of Basis Weight of Individual Piece)

The coefficient of variation of the basis weight of 432 pieces of copper fiber nonwoven fabric obtained in the Examples and Comparative Examples was calculated by calculating the basis weight of each piece from the area and the mass, and dividing the standard deviation of a total of 432 points by the average value.

(Average Space Factor)

The space factor of the copper fiber nonwoven fabric pieces obtained in the Examples and Comparative Examples was calculated as follows.

Space factor (%)=basis weight of copper fiber nonwoven fabric/(thickness of copper fiber nonwoven fabric×true density of copper fiber)×100

The arithmetic mean of a total of 432 points was used as the average value of the space factor.

The calculated data list is shown in Table 1, and the physical properties of the metal fibers are shown in Table 2.

Equation 1

Figure 6:
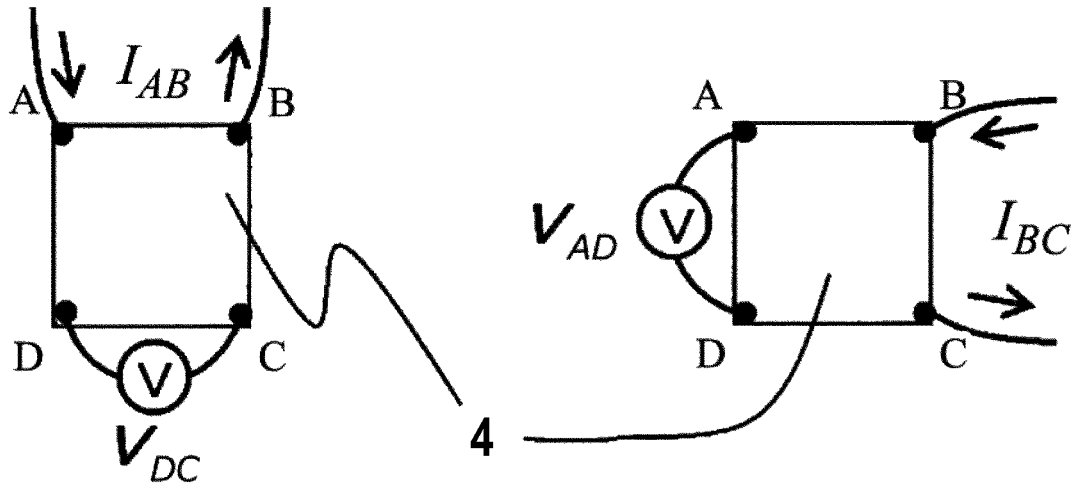
FIG. 6 is a schematic view showing a sheet resistance measuring method of a piece of a metal fiber nonwoven fabric.

(1) As shown in FIG. 6, two types of I-V characteristics were measured, and then the resistance was calculated.

$$R_{AB,CD} = \frac{V_{DC}}{I_{AB}}$$

$$R_{BC,DA} = \frac{V_{AD}}{I_{BC}}$$

(2) Rs (sheet resistance) was calculated from the following formulas.

$$R_S = \frac{\pi}{\ln 2}\frac{R_{AB,CD} + R_{BC,DA}}{2} f\left(\frac{R_{AB,CD}}{R_{BC,DA}}\right)(R_{AB,CD} \geq R_{BC,DA})$$

TABLE 1

| | | Example 1 | Example 2 | Example 3 | Example 4 | Example 5 | Example 6 | Example 7 | Example 8 | Comparative Example 1 |
|---|---|---|---|---|---|---|---|---|---|---|
| Base weight ($g/cm^2$) | Average value | 302.7 | 340.5 | 209.5 | 309.7 | 301.6 | 48.0 | 52.2 | 298.8 | 303.6 |
| | Medium value | 303.0 | 339.5 | 209.8 | 310.0 | 302.8 | 47.9 | 52.2 | 297.7 | 296.2 |
| | Standard deviation | 27.6 | 30.1 | 11.0 | 17.8 | 11.7 | 1.1 | 1.9 | 21.2 | 52.2 |
| | Coefficient of variation | 9.1 | 8.8 | 5.2 | 5.8 | 3.9 | 2.3 | 3.7 | 7.1 | 17.2 |
| | Maximum value | 367.7 | 457.3 | 237.4 | 355.6 | 349.1 | 52.7 | 57.8 | 427.8 | 584.1 |
| | Minimum value | 215.2 | 256.1 | 179.1 | 261.4 | 264.6 | 45.3 | 47.6 | 263.8 | 199.5 |
| | Difference between Maximum value and Minimum value | 152.5 | 201.2 | 58.3 | 94.2 | 84.5 | 7.4 | 10.2 | 164.0 | 384.6 |
| Space factor (%) | Average value | 11.0 | 12.7 | 10.3 | 34.5 | 33.5 | 4.0 | 7.8 | 33.7 | 11.9 |
| | Medium value | 11.1 | 12.8 | 10.2 | 35.0 | 33.6 | 3.9 | 7.7 | 33.8 | 11.9 |
| | Standard deviation | 1.2 | 1.3 | 0.9 | 4.2 | 2.2 | 0.7 | 0.8 | 2.0 | 1.3 |
| | Coefficient of variation | 10.9 | 10.5 | 8.7 | 12.2 | 6.5 | 16.5 | 10.4 | 6.0 | 10.7 |
| | Maximum value | 16.9 | 16.8 | 13.4 | 44.5 | 40.5 | 7.9 | 10.8 | 48.4 | 16.7 |
| | Minimum value | 6.7 | 7.7 | 7.9 | 23.1 | 25.2 | 2.6 | 5.9 | 21.8 | 8.0 |
| | Difference between Maximum value and Minimum value | 10.2 | 9.1 | 5.6 | 21.4 | 15.3 | 5.2 | 4.9 | 26.6 | 8.7 |

TABLE 2

| | Example 1 | Example 2 | Example 3 | Example 4 | Example 5 | Example 6 | Example 7 | Example 8 | Comparative Example 1 |
|---|---|---|---|---|---|---|---|---|---|
| Fiber length (mm) | 10 | 5 | 3 | 5 | 5 | 3 | 3 | 3 | 10 |
| Fiber diameter (μm) | 18.5 | 18.5 | 18.5 | 18.5 | 18.5 | 2 | 8 | 8 | 18.5 |
| Aspect ratio | 541 | 270 | 162 | 270 | 270 | 1500 | 375 | 375 | 541 |
| Cross-sectional shape of fiber | Substantially ring shape | Substantially ring shape | Substantially ring shape | Substantially ring shape | Substantially ring shape | Irregular shape | Irregular shape | Irregular shape | Substantially ring shape |

(Sheet Resistance Value)

In accordance with the individual piece resistance measurement procedure shown in FIG. 6, the voltage and current of each piece were measured and the sheet resistance value was calculated from the following Equation 1 by the van der Pauw method.

Moreover, in FIG. 6, reference numeral 4 denotes a copper fiber nonwoven fabric piece.

Power supply: PA 250-0.25 A (manufactured by KENWOOD)

Voltmeter. KEITHLEY DMM 7510 7 1/2 DIGIT MULTIMETER (manufactured by Tektronix)

-continued $$\cosh\left(\frac{\ln 2}{f\left(\frac{R_{AB,CD}}{R_{BC,DA}}\right)}\frac{\frac{R_{AB,CD}}{R_{BC,DA}} - 1}{\frac{R_{AB,CD}}{R_{BC,DA}} + 1}\right) = \frac{\exp\left(\frac{\ln 2}{f\left(\frac{R_{AB,CD}}{R_{BC,DA}}\right)}\right)}{2}$$

The coefficient of variation of the sheet resistance value of the copper fiber nonwoven fabric piece of Example 2 calculated by this measurement method was 12.2 and the coefficient of variation of the sheet resistance value of the copper fiber nonwoven fabric piece of Comparative Example 1 was 23.8.

Figure 4:
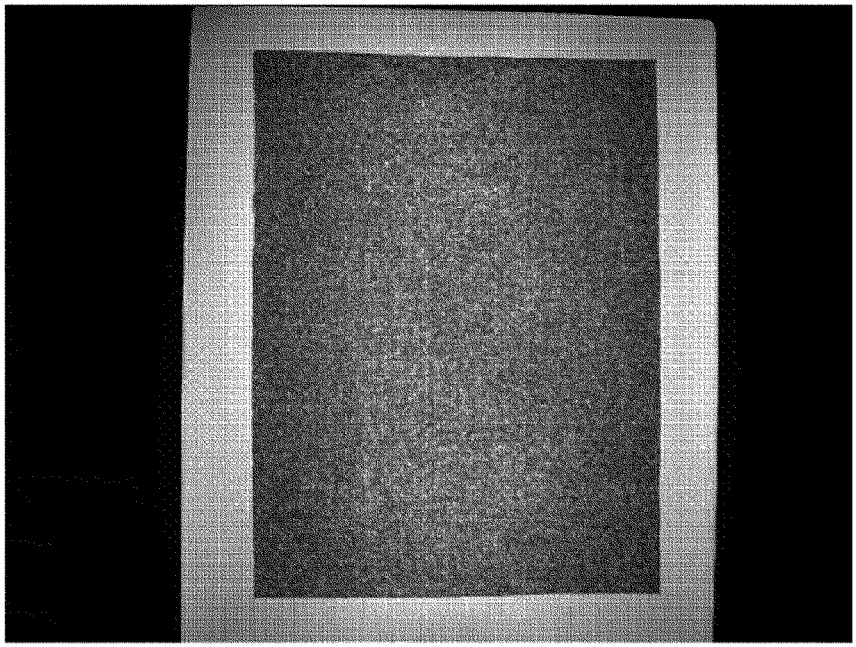
FIG. 4 is a photograph showing a copper fiber nonwoven fabric with high homogeneity of Example 3.

FIG. 4 is a photograph taken by placing a light source on the back surface to confirm the homogeneity of the copper fiber nonwoven fabric of Example 3. As compared with the photograph of the copper fiber nonwoven fabric of Comparative Example 1 shown in FIG. 5, the presence of remarkable lumps 3 could not be confirmed and homogeneity was markedly improved. In addition, this visual observation appears as a difference in coefficient of variation (CV value).

Figure 5:
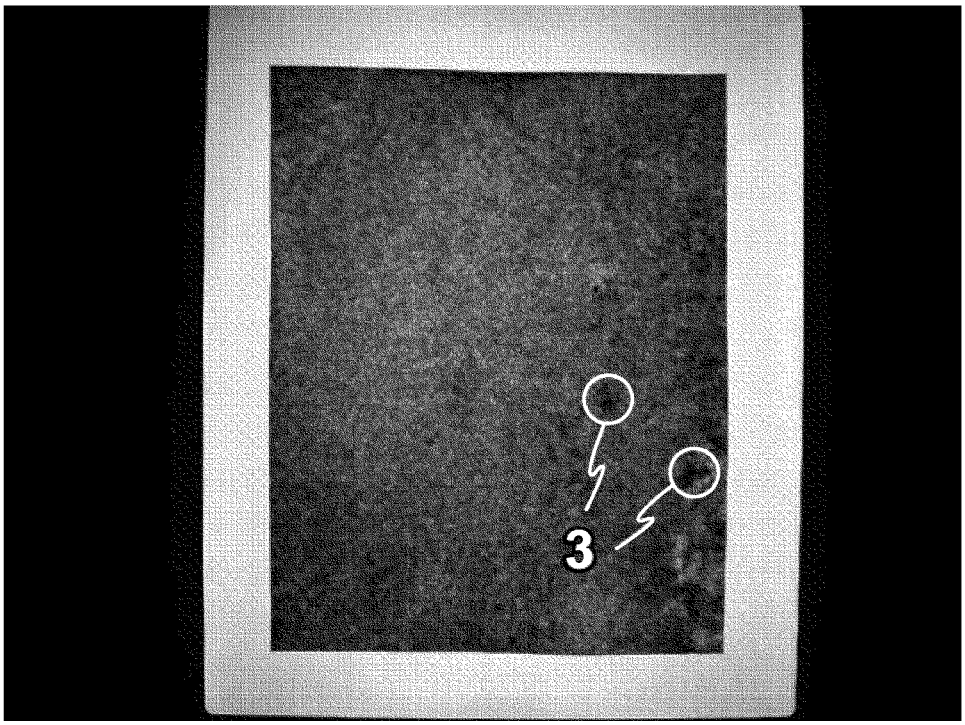
FIG. 5 is a photograph showing a copper fiber nonwoven fabric with low homogeneity of Comparative Example 1.

The copper fiber nonwoven fabrics of Examples 1 to 5 and the stainless steel fiber nonwoven fabrics of Examples 6 to 8 had a coefficient of variation of the basis weight of 10 or less and each piece had high homogeneity. However, the lumps 3 were densely collected in the copper fiber nonwoven fabric of Comparative Example 1 having a coefficient of variation of the basis weight of 17.2 as can be seen in FIG. 5.

As described above, the metal fiber nonwoven fabric obtained in Examples can produce individual pieces with extremely small difference in quality when processed into an extremely small area form after being produced in an industrially sufficient area, and when processed into a relatively large area after being produced in an industrially sufficient area, it has small variation in-plane.

INDUSTRIAL APPLICABILITY

Since the metal fiber nonwoven fabric of the present invention has high denseness and is homogeneous, the metal fiber nonwoven fabric of the present invention can be used for various purposes including members for electronic parts. For example, the metal fiber nonwoven fabric of the present invention can be widely used such as a windshield of a microphone, an electromagnetic wave noise countermeasure member, a copper fiber nonwoven fabric used in solders for bonding a semiconductor chip, heat radiation, heating, electromagnetic wave countermeasures and the like of building materials, vehicles, aircrafts, ships and the like.

EXPLANATION OF REFERENCE NUMERAL

1 copper fiber
2 bonding portion
3 lump
4 piece

The invention claimed is:

1. A metal fiber non-woven fabric in which metal fibers are bonded to each other, wherein the metal fiber non-woven fabric has a coefficient of variation (CV value) of a basis weight in accordance with JIS Z 8101 (ISO 3534: 2006) per 1 $cm^2$ of 10% or less, the metal fiber non-woven fabric consists of the metal fibers, the metal fibers are directly fixed to each other or sintered with each other, a cross-sectional shape perpendicular to a longitudinal direction of the metal fibers is substantially a circle, the metal fibers have an average length of 1 to 10 mm, and an average of the space factor of the metal fibers is 5% to 50%.

2. The metal fiber non-woven fabric according to claim 1, wherein the metal fibers are copper fibers.

3. The metal fiber non-woven fabric according to claim 1, wherein the metal fiber non-woven fabric is a member for an electronic part.

4. The metal fiber non-woven fabric according to claim 1, wherein the metal fibers have an average length of 3 to 5 mm.

5. The metal fiber non-woven fabric according to claim 1, wherein the average of space factor of the metal fibers is 15% to 40%.

6. The metal fiber non-woven fabric according to claim 1, wherein the metal fibers are stainless steel fibers.

* * * * *